US009404495B2

(12) United States Patent
Cadeddu

(10) Patent No.: US 9,404,495 B2
(45) Date of Patent: Aug. 2, 2016

(54) VARIABLE DISPLACEMENT PUMP WITH DOUBLE ECCENTRIC RING AND DISPLACEMENT REGULATION METHOD

(71) Applicant: VHIT S.P.A., Offanengo (CR) (IT)

(72) Inventor: Leonardo Cadeddu, Offanengo (IT)

(73) Assignee: VHIT S.P.A., Offanengo (IT)

( * ) Notice: Subject to any disclaimer, the term of this patent is extended or adjusted under 35 U.S.C. 154(b) by 86 days.

(21) Appl. No.: 14/386,229

(22) PCT Filed: Mar. 13, 2013

(86) PCT No.: PCT/IB2013/051977

§ 371 (c)(1),
(2) Date: Sep. 18, 2014

(87) PCT Pub. No.: WO2013/140305

PCT Pub. Date: Sep. 26, 2013

(65) Prior Publication Data

US 2015/0050173 A1 Feb. 19, 2015

(30) Foreign Application Priority Data

Mar. 19, 2012 (IT) ..... T02012A0236
Nov. 20, 2012 (IT) ..... TO2012A1007

(51) Int. Cl.
*F03C 2/00* (2006.01)
*F03C 4/00* (2006.01)
(Continued)

(52) U.S. Cl.
CPC ..... *F04C 14/226* (2013.01); *F04C 2/3446* (2013.01); *F04C 14/223* (2013.01);
(Continued)

(58) Field of Classification Search
CPC .... F04C 14/223; F04C 14/226; F04C 2/3446; F04C 2/3441; F04C 18/3441; F04C 18/3446; F04C 18/3564
USPC ..... 418/16, 22, 26, 29, 259–260
See application file for complete search history.

(56) References Cited

U.S. PATENT DOCUMENTS 2,685,842 A 8/1954 Hufferd
3,234,816 A * 2/1966 Von Thuengen ..... F04C 14/223 418/16

(Continued)

FOREIGN PATENT DOCUMENTS

SU 785548 A 12/1980

OTHER PUBLICATIONS

International Search Report for PCT/IB2013/051977 dated Jun. 21, 2013.
Written Opinion of PCT/IB2013/051977 dated Jun. 21, 2013.

*Primary Examiner* — Theresa Trieu
(74) *Attorney, Agent, or Firm* — Sughrue Mion, PLLC

(57) ABSTRACT

A rotary positive displacement pump for fluids, in particular for the lubrication oil of a motor vehicle engine (60), has a displacement that can be regulated by the rotation of a stator ring (112) having an eccentric cavity (113) in which the rotor (15) of the pump (1) rotates. The stator ring (112) is located in an eccentric cavity (13) of an external ring (12), which is configured as a multistage rotary piston for displacement regulation and is arranged to be directly driven by a fluid under pressure, in particular oil taken from a delivery side (19) of the pump or from a point of the lubrication circuit located downstream of the oil filter (62). A method of regulating the displacement of the pump (1) and a lubrication system for the engine of a motor vehicle in which the pump (1) is used.

20 Claims, 4 Drawing Sheets

(51) Int. Cl.

| | |
|---|---|
| ***F04C 2/00*** | (2006.01) |
| ***F04C 14/22*** | (2006.01) |
| ***F04C 18/344*** | (2006.01) |
| ***F04C 18/356*** | (2006.01) |
| *F04C 2/344* | (2006.01) |

(52) U.S. Cl.
CPC ..... *F04C18/3441* (2013.01); *F04C 18/3446* (2013.01); *F04C 18/3564* (2013.01); *F04C 2/3441* (2013.01)

(56) References Cited

U.S. PATENT DOCUMENTS 3,334,546 A * 8/1967 Vuolle-Apiala ..... F04C 14/223 418/16
4,177,024 A * 12/1979 Lohn ..... F04C 14/223 418/16
4,406,599 A * 9/1983 Stephan ..... F01C 21/0809 418/22
4,778,352 A 10/1988 Nakajima

* cited by examiner

VARIABLE DISPLACEMENT PUMP WITH DOUBLE ECCENTRIC RING AND DISPLACEMENT REGULATION METHOD

CROSS REFERENCE TO RELATED APPLICATIONS

This application is a National Stage of International Application No. PCT/IB2013/051977 filed Mar. 13, 2013, claiming priority based on Italian Patent Application Nos. TO2012A000236, filed Mar. 19, 2012 and TO2012A001007, filed Nov. 20, 2012, the contents of all of which are incorporated herein by reference in their entirety.

TECHNICAL FIELD

The present invention relates to variable displacement pumps, and more particularly it concerns a rotary positive displacement pump of the kind in which the displacement variation is obtained by means of the rotation of an eccentric ring (stator ring).

Preferably, but not exclusively, the present invention is employed in a pump for the lubrication oil of a motor vehicle engine.

PRIOR ART

It is known that, in pumps for making lubricating oil under pressure circulate in motor vehicle engines, the capacity, and hence the oil delivery rate, depends on the rotation speed of the engine. Hence, the pumps are designed so as to provide a sufficient delivery rate at low speeds, in order to ensure lubrication also under such conditions. If the pump has fixed geometry, at high rotation speed the delivery rate exceeds the necessary rate, whereby a high power absorption, and consequently a higher fuel consumption, and a greater stress of the components due to the high pressures generated in the circuit occur.

In order to obviate this drawback, it is known to provide the pumps with systems allowing a delivery rate regulation at the different operating conditions of the vehicle, in particular through a displacement regulation. Different solutions are known to this aim, which are specific for the particular kind of pumping elements (external or internal gears, vanes . . . ).

A system often used in rotary pumps employs a stator ring with an internal cavity, eccentric relative to the external surface, inside which the rotor, in particular a vane rotor, rotates, the rotor being eccentric with respect to the cavity under operating conditions of the pump. By rotating the stator ring by a given angle, the relative eccentricity between the rotor and the cavity, and hence the displacement, is made to vary between a maximum value and a minimum value, substantially tending to zero (stall operating condition). A suitably calibrated opposing resilient member allows the rotation when a predetermined delivery rate is attained and makes the pump substantially deliver such a predetermined delivery rate under steady state conditions. A pump of this kind is disclosed for instance in U.S. Pat. No. 2,685,842.

U.S. Pat. No. 4,406,599 discloses a pump with a pair of stator rings arranged side by side and having respective oval cavities, which are mutually aligned in a maximum displacement condition of the pump. The displacement is made to vary by rotating the rings relative to each other in opposite directions by means of gears or racks, external to the pump, which mesh with teeth formed on the external surfaces of the rings. The rotation is driven by a piston responsive to the pressure conditions in a circuit utilising the pumped fluid.

The presence of external control members makes such a prior art pump complex and relatively cumbersome.

It is an object of the present invention to provide a variable displacement pump with double eccentric ring, and a method of regulating the displacement of such a pump, which obviate the drawbacks of the prior art.

DESCRIPTION OF THE INVENTION

According to the invention, this is obtained in that the stator ring is housed within an eccentric cavity of an external ring, which is configured as a multistage rotary piston for displacement regulation, arranged to be directly driven by a fluid under pressure in order to be rotated within a predetermined angular interval and arranged to transmit the rotary motion to the stator ring in order to make it rotate in opposite direction to the external ring.

Advantageously, at least one piston stage may have an actuating surface, onto which the fluid under pressure acts, having an area which changes during the piston rotation.

Preferably, for the transmission of the rotation to the stator ring, facing surfaces of the external ring and the stator ring have formed thereon respective toothed sectors with which an idle toothed wheel meshes, the toothed sector of the external ring being concentric with the external surface of the ring and the toothed sector of the stator ring being formed on an arc of an involute resulting from a composition of the relative rotations of the eccentricities of the cavities of both rings.

The rotation of the external ring is opposed by a flat spiral spring, which may be a bimetallic spring so as to exhibit a temperature-dependent behaviour.

The invention also implements a method of regulating the displacement of a rotary positive displacement pump by means of the rotation of an eccentric stator ring inside which the rotor rotates, the method comprising the steps of:

- providing an external ring having an eccentric cavity within which the stator ring is housed;
- configuring the external ring as a multistage rotary piston;
- directly controlling the piston rotation by means of fluid under pressure; and
- transmitting the rotation of the external ring to the stator ring in such a manner that the two rings rotate in opposite directions.

Advantageously, the step of directly controlling the piston rotation by means of fluid under pressure includes at least:

- applying the fluid to a first stage of the piston in order to maintain the displacement at a first value determined through a suitable calibration of members opposing the rotation; and
- applying the fluid to a second stage of the piston, simultaneously with the application to the first stage and upon an external command, in order to bring the displacement to a second value different from the first one.

According to a further aspect of the invention, there is also provided a lubrication system for a motor vehicle engine, in which the adjustable displacement pump and the method of regulating the displacement set forth above are employed.

BRIEF DESCRIPTION OF THE FIGURES

Further features and advantages of the invention will become apparent from the following description of preferred embodiments, given by way of non limiting examples with reference to the accompanying drawings, in which.

DESCRIPTION OF PREFERRED EMBODIMENTS

Figure 1:
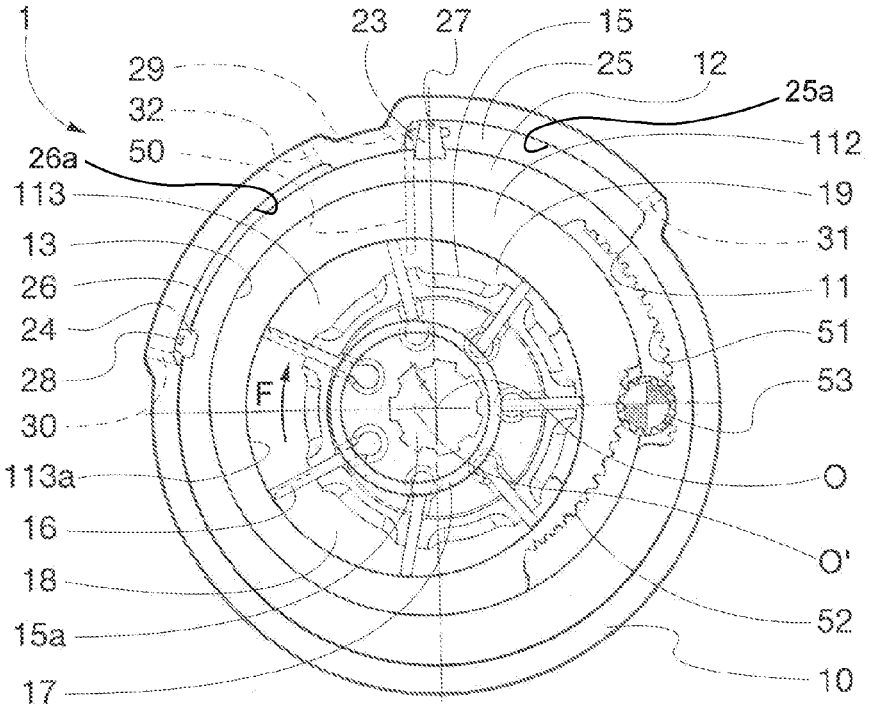
FIG. 1 is a plan view of a pump according to the invention, from which the cover has been removed, in the maximum displacement condition.
Figure 2:
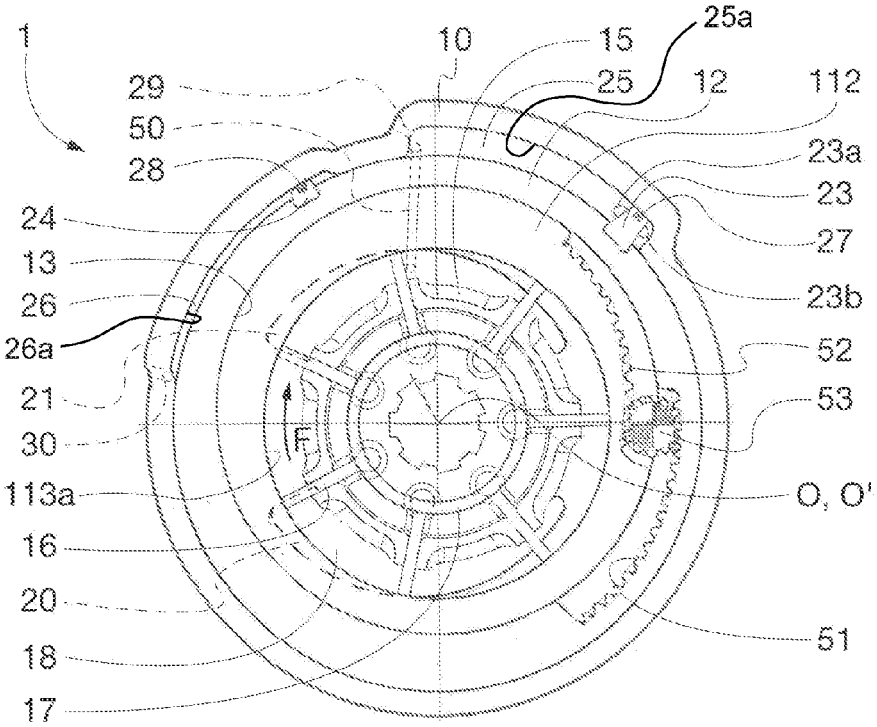
FIG. 2 is a view similar to FIG. 1, in the minimum displacement condition.

Referring to FIGS. 1 and 2, a pump according to the invention, generally denoted by reference numeral 1, includes a body 10 having a cavity 11 with substantially circular cross-section in which a first movable ring 12 (external ring) is located, which in turn has an axial cavity 13, also with substantially circular cross-section, eccentrically arranged relative to cavity 11. A second movable ring 112 (stator ring) is located in cavity 13, which ring in turn it has an axial cavity 113, also with substantially circular cross-section, eccentrically arranged relative to cavity 13 and having a centre O'. Rings 12 and 112 are arranged to rotate in mutually opposite directions by a certain angle in order to vary the pump displacement, as it will be better disclosed below. In particular, ring 12 acts as a multistage rotary piston and is arranged to cause the rotation of internal ring 112, acting as an eccentric stator ring. Cavity 113 in turn houses a rotor 15, rigidly connected to a driving shaft 15*a* making it rotate about a centre O, for instance in clockwise direction, as shown by arrow F. In a maximum displacement position (shown in FIG. 1), centres O and O' are located on a same axis and are mutually spaced apart, and rotor 15 is substantially tangent to side surface 113*a* of cavity 113. In a minimum displacement position (shown in FIG. 2), rotor 15 and cavity 113 are coaxial or substantially coaxial.

In the present description, the term "coaxial or substantially coaxial" is used to denote a minimum distance, tending to O, between centres O and O'.

Advantageously, eccentric rings 12 and 112 are mounted in such a manner that, in the minimum displacement position shown in FIG. 2, external ring 12 is oriented so that its minimum radial thickness is located at the top in the Figure and internal ring 112 is oriented so that its minimum radial thickness is located at the bottom in the Figure. Otherwise stated, the eccentricities of the respective cavities 13, 113 are offset by 180°. Preferably, cavities 13, 113 have the same eccentricity relative to the external surface of the respective ring.

Rotor 15 has a set of vanes 16, radially slidable in respective radial slots. At an outer end, vanes 16 are at a minimum distance from side surface 113*a* of cavity 113, whereas at the inner end they rest on guiding or centring rings 17, mounted at the axial ends of rotor 15 and arranged to maintain the minimum distance between vanes 16 and surface 113*a* under any condition of eccentricity. Also centring rings 17 will be coaxial or substantially coaxial with rotor 15 in the minimum displacement position.

A suction chamber 18, communicating with a suction duct 20, and a delivery chamber 19, communicating with a delivery duct 21, are defined between rotor 15 and surface 113*a*. Such chambers are substantially symmetrical and have phasings that are ideal for the maximum volumetric efficiency, as it is clearly apparent for the skilled in the art.

Rings 12 and 112, as well as centring rings 17 and rotor 15, are preferably formed by a process of metal powder sintering, or by moulding thermoplastic or thermosetting materials, with possible suitable finishing operations on some functional parts, according to the dictates of the art.

In order to control the rotation of external ring 12, the latter has on its external surface a pair of radial appendages 23, 24, which project into respective chambers 25, 26 defined by ring 12 and by respective recesses in the side surface of cavity 11 and slide onto bases 25*a*, 26*a* of chambers 25, 26, respectively. Such appendages may be integral parts of ring 12 or they may be separate elements, fastened to the ring, or yet radially slidable vanes, which are guided in suitable radial slots formed in ring 12 and are suitably pushed into contact with bases 25*a*, 26*a* of chambers 25, 26 by resilient means. In the region where they are in contact with the base of the respective chamber, appendages 23, 24 may be equipped with gaskets 27, 28, respectively, for optimising the hydraulic seal.

One of the chambers (in the illustrated example, chamber 25) is permanently connected to delivery chamber 19, through a duct 50, or preferably to the members utilising the pumped fluid (in particular, in the preferred application, to a point of the lubrication system located downstream the oil filter), through a first regulation duct, not shown in these Figures, ending into an inlet passage 29. By means of a valve operated by the electronic control unit of the vehicle, the other chamber can in turn be put in communication with the members utilising the pumped fluid, through a second regulation duct ending into an inlet passage 30. Also the valve and the second regulation duct are not shown in these Figures.

Both appendages 23, 24 are therefore exposed to the fluid pressure conditions existing at the delivery side and/or in the utilisation members and they form a first and a second stage of displacement regulation, respectively, the second stage operating jointly with the first stage, as it will be better explained in the description of the operation. The radial size and the circumferential amplitudes of chambers 25, 26 will be determined by the operation characteristics required from the pump. Chambers 25, 26 can also be defined as regulation cylinders, and appendages 23, 24 form the corresponding pistons. One appendage (appendage 23 in the drawing) may be provided with projections 23*a*, 23*b* acting as stops in the rest position and in the operating condition, respectively, and keeping the appendage spaced apart from the adjacent end wall of chamber 25 at the end of the ring stroke.

Both chambers 25, 26 are equipped with drainage ducts 31, 32 for discharging oil seepages, if any, and for compensating volume variation generated when ring 12 is made to rotate.

In the illustrated embodiment, drains 31, 32 communicate with the outside of the pump. In other embodiments, drains 31, 32 are for instance connected to the suction chamber.

If necessary, means are provided for adjusting the drainage flows in order to damp possible hydraulic pulsations of the displacement regulating system.

Toothed sectors 51, 52 are formed on facing surfaces of rings 12, 112 and an idle toothed wheel 53 is interposed between said sectors. The "driving" toothed sector 51 is concentric with the external surface of ring 12, guided within chamber 11, whereas the "driven" toothed sector 52 is formed on the arc of the involute resulting from the composition of the relative rotations of the eccentricities of cavities 13, 113. If the eccentricities are the same, during the relative rotation of the rings centre O' of cavity 112 will then move along a rectilinear trajectory.

Figure 3:
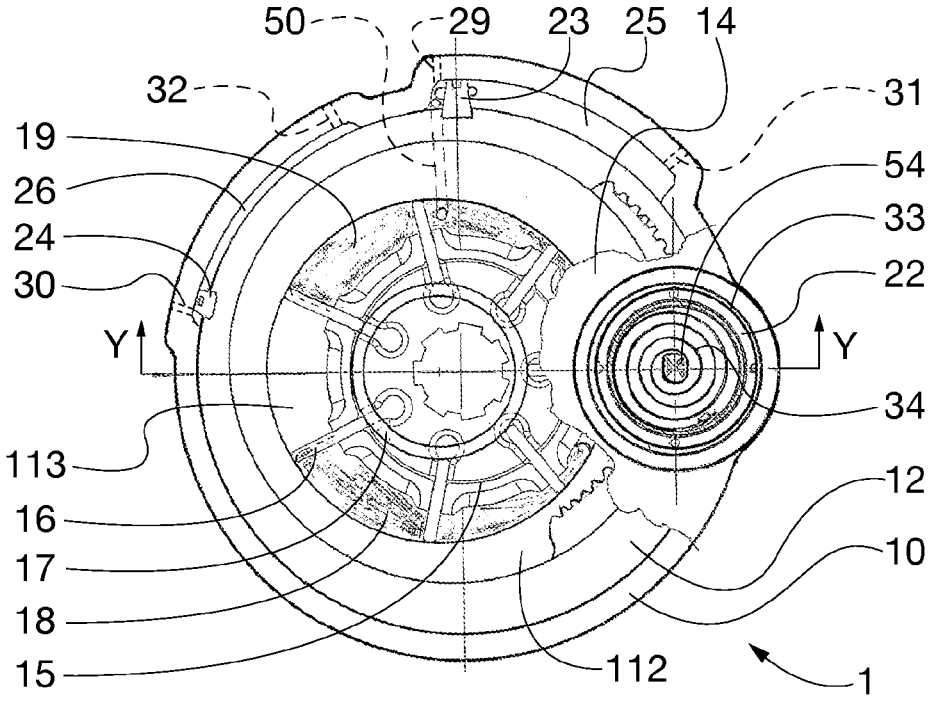
FIG. 3 is a plan view, similar to FIG. 2, showing the displacement regulation mechanism integrated in the cover.
Figure 4:
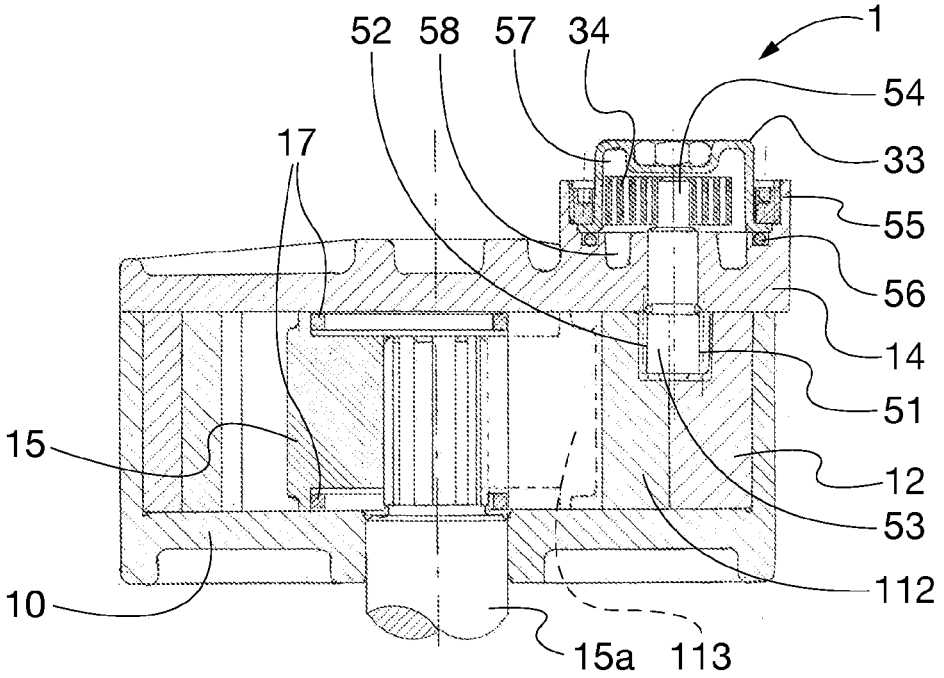
FIG. 4 is a cross-sectional view of the pump according to a plane passing through line Y-Y in FIG. 3.

Referring to FIGS. 3, 4, idle wheel 53 cooperates with a member 34 opposing the rotation of ring 12, in particular a flat spiral spring, preloaded so as to prevent the rotation of the ring as long as the pressure applied to appendage 23 (or the overall pressure applied to appendages 23 and 24) is lower than a predetermined threshold. Spiral spring 34 is located in a casing 33 that, in the illustrated exemplary embodiment, is fastened to a cover 14 closing one end of cavities 11, 13 and 113, which, in the illustrated example, are blind cavities. The inner end portion of spring 34 is so shaped as to be coupled with the end portion of shaft 54 of idle wheel 53, whereas the outer end portion is locked to the internal wall of casing 33. The latter may be rotated, for instance by using a dynamometric key, in order to adjust the preloading of spring 34. A ring nut 55 allows blocking casing 33 in the desired calibration position, independently of the constructive tolerances of the whole mechanism. A sealing gasket 56 is moreover provided between casing 33 and cover 14 in order to isolate internal chamber 57 of the same casing from the outside. A drain 58 puts such a chamber in communication with suction chamber 18, for the aims that will be disclosed below.

It is to be appreciated that, during the regulation rotation, spiral spring 34, thanks to the negligible variation of the twisting torque and to the transmission ratio of the gear mechanism, will undergo negligible variations of its torque opposing the hydraulic torque of the rotary piston.

Advantageously, spring 34 may be made of a bimetallic material, so that its characteristic may suitably change depending on the operation temperature.

Figure 5:
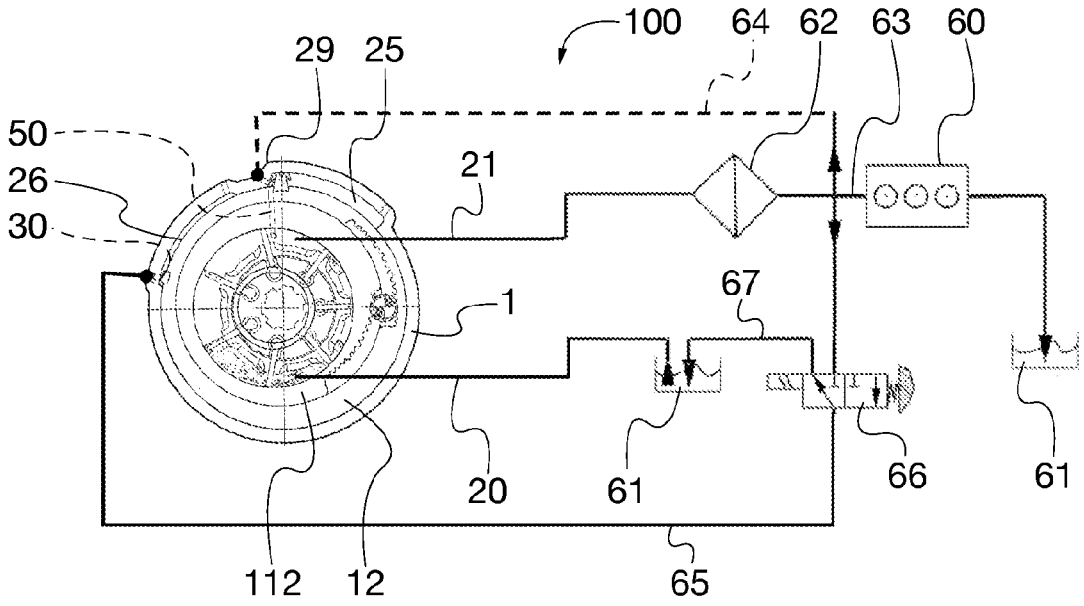
FIGS. 5 and 6 are diagrams of a lubrication circuit of a motor vehicle engine using the pump according to the invention, relative to the maximum and minimum displacement condition, respectively.
Figure 6:
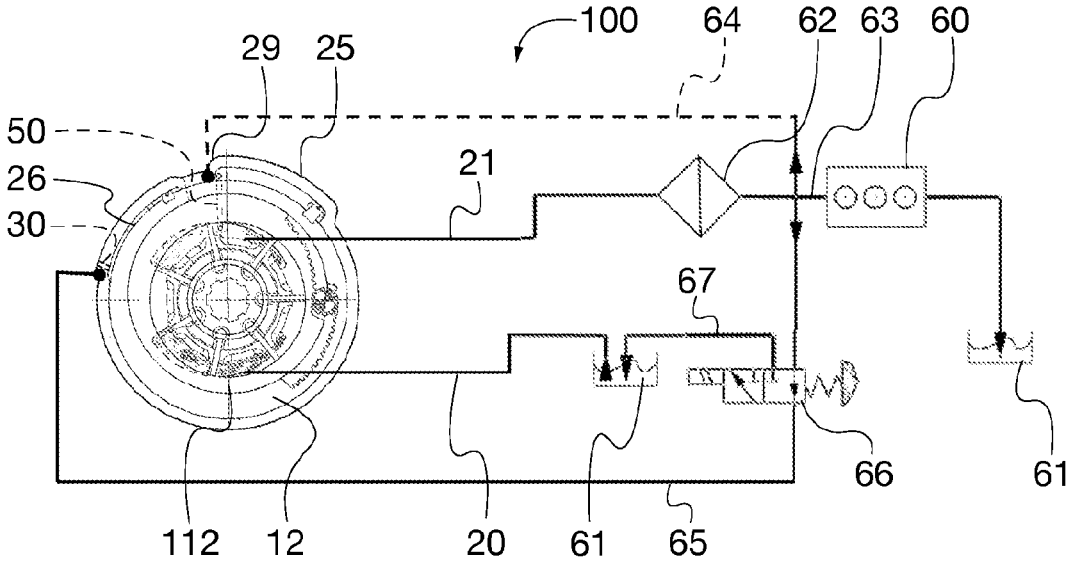

Turning to FIGS. 5 and 6, lubrication circuit 100 of a motor vehicle engine 60 using pump 1 is shown. Reference numerals 61 and 62 denote the oil sump and the oil filter, connected in conventional manner to suction and delivery ducts 20, 21 through ducts denoted by the same reference numerals, and reference numeral 63 denotes the outlet duct of filter 62, conveying the oil to engine 60. A first branch of outlet 63 of oil filter 62 forms the first regulation duct 64, which conveys the oil to chamber 25 and can be used in the alternative to passage 50. A second branch of outlet 63 of oil filter 62 forms the second regulation duct 64, in which valve 66 controlled by the electronic control unit, for instance an electromagnetic valve, is connected. Depending on the position of such a valve, oil leaving filter 62 may be conveyed to chamber 26 or intercepted: in the latter case, the oil present in chamber 25 and in duct 65 may be sent back to oil sump 61 through valve 66 and duct 67.

It is pointed out that the choice of connecting chamber 25 directly to delivery duct 21 or, in the alternative, to outlet 63 of the oil filter depends on the requirements defined by the engine manufacturer. However, the connection to the filter outlet is the choice ensuring the greatest stability in the regulation pressure since, as known, due to the nature of the positive displacement pumps, the delivery pressure has surges which are damped by filter 62. Moreover, as a skilled in the art will readily appreciate, the displacement regulation is independent of any pressure drop caused by the filter, for instance due to the greater or smaller clogging thereof because of impurities, or due to changes in oil viscosity.

Moreover, valve 66 might be housed in the body of pump 1, in which case ducts 64, 65 will be passages formed in said body.

The operation of pump 1 is as follows.

Under rest conditions, pump 1 is in the condition shown in FIG. 1. As said, centre of rotation O of rotor 15 is offset relative to centre O' of cavity 113 of eccentric ring 112 and rotor 15 is located close to wall 113*a* of the cavity. When pump 1 is started, the clockwise rotation of rotor 15 will give rise to an oil flow through chamber 19 and the associated delivery duct 21 and, at the same time, an equal volume of oil will be sucked from chamber 18 and the associated suction duct 20. As the rotation speed and the flow rate increase, the lubrication system of the engine, by opposing an increasing resistance to the flow, will make the pressure increase.

The delivery pressure or the pressure downstream oil filter 62 are brought to chamber 25 through duct 50 or 64 and they will act on appendage 23, thereby creating an hydraulic thrust on ring 12 and generating a rotation torque. Once the calibration value of the counteracting spring 34 has been attained, such a torque will cause a rotation of ring 12, in this case in clockwise direction, which rotation will be transmitted to ring 112 through idle wheel 53 meshing with toothed sectors 51 and 52 and will make ring 112 rotate in counterclockwise direction by the same angle. If, as it has been assumed, the eccentricities of cavities 13 and 113 relative to the external surfaces of the respective rings are the same, the rotation of ring 112 will cause a rectilinear translation of centre O' towards the right, proportional to the amount of the rotation, thereby proportionally reducing the distance between rotor 15 and cavity 113 and consequently the pump displacement, and stabilising the pressure at the calibration value. As parameters such as the speed, the fluidity/temperature of the fluid, the engine "permeability" (intended as the amount of oil used by the engine) and so on change, such a pressure will be maintained and controlled through the variation of the eccentricity and hence of the displacement.

When, as a function of the different operating parameters of the engine, as detected by the electronic control unit of the vehicle, it is desired to operate at a lower pressure value, with a consequent reduction in the absorbed power, fluid under pressure can be fed also to chamber 26 by means of valve 66, whereby a supplementary hydraulic thrust concordant with the thrust exerted on appendage 23 is created on appendage 24. In this way, the rotation torque of the piston is increased and the pump displacement is reduced. Stopping the feed to chamber 26 will bring the pressure back to the previous higher value through the variation of the displacement.

The rotation of the rings may continue until the position shown in FIG. 2 is attained, where projection 23*b* of appendage 23 is in contact with the wall of chamber 25, centres O and O' coincide and vanes 16 and centring rings 17 rotate with the rotor without changes in their radial relative position. Consequently, the displacement is null and the pump is in stall condition. It is to be pointed out that this position may be taken when a hydraulic lock of the delivery pressure is approaching. In the constructional practice, a minimum displacement is preferably maintained by protecting the pump with a maximum pressure valve.

By mutually exchanging the drains and the oil inlets to chambers 25, 26, it is also possible to generate torques adding to the counteracting torque generated by spring 34.

An important parameter in managing the delivery rate/pressure of an oil pump for thermal engines is temperature, the increase of which makes the oil become more fluid and the engine permeability increase. Consequently, the pump displacement should proportionally increase. This may be assisted if the opposing load of spring 34 increases. In order to obtain this, flat spiral spring 34 may be made of a bimetallic material such that temperature causes an increase in the rigidity and hence in the counteracting torque. In order to obtain the change in the rigidity, the small oil flow rate for the lubrication of shaft 54 of idle wheel 53 may be exploited: the oil, after having licked casing 33 of spring 34 and having transmitted its temperature to the same spring, can freely discharge to the suction chamber through drain 58.

In the pump described above, bases 25*a*, 26*a* of chambers 25, 26, when viewed in plan, are arcs of circumference the centre of which is located on the rotation axis of ring 12, and chambers 25, 26 have constant radial sizes. This entails that the different stages or pistons have actuating surfaces, on which the fluid under pressure acts, having constant areas and therefore generate a torque that is proportional to the pressure of the actuating fluid and is constant over the whole rotation of ring 12.

Figure 7:
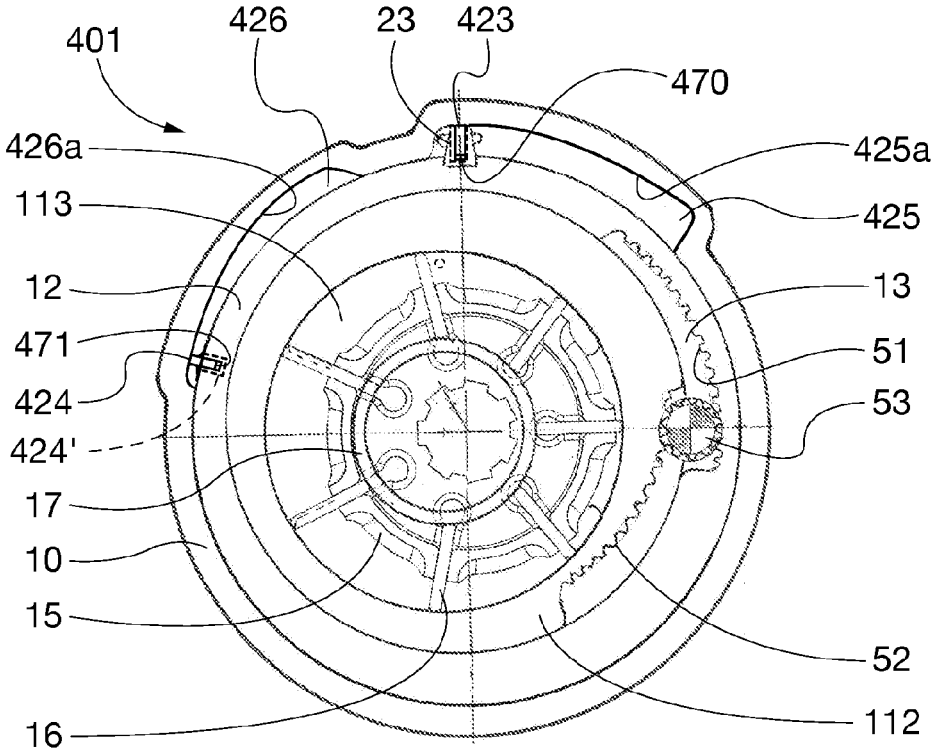
FIGS. 7 and 8 are views similar to FIGS. 1 and 2, relating to a variant embodiment.
Figure 8:
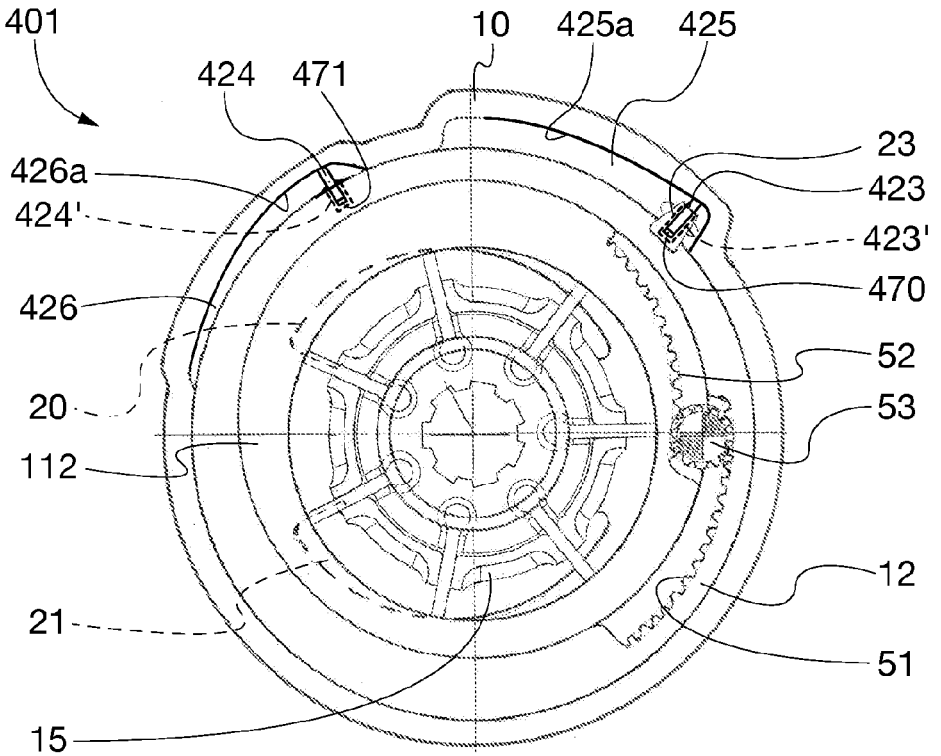

FIGS. 7 and 8 show an embodiment in which the torque applied to ring 12 may be changed during the displacement regulation in order to take into account possible changes in the resistant torques encountered during such a regulation, for instance due to changes in the resistance opposed by opposing spring 34 and/or in the rotation frictions.

In the pump according to this embodiment, denoted 401, the displacement regulation pistons consist of radially slidable vanes 423, 424, which are guided in respective seats 423', 424' and are pushed into contact with bases 425*a*, 426*a* of chambers 425, 426 by resilient means 470, 471, for instance spiral or leaf springs. Bases 425*a*, 426*a*, when viewed in plan, are shaped as arcs of circumferences the centres of which do not coincide with the centre of rotation of ring 12, and therefore the chambers have variable radial sizes (in particular, in the Figure, radial sizes steadily increasing in the direction of the rotation performed by ring 12 for bringing the pump from the maximum displacement position to the minimum displacement position). The arcs forming bases 425*a*, 426*a* may possibly have different radiuses. It is also possible that only one chamber (in particular, the chamber in which the stage permanently exposed to the fluid pressure moves, for instance chamber 425) has a variable radial size. The skilled in the art will have no problem in designing and sizing vanes 423, 424 and resilient elements 470, 471 so as to ensure the contact between the vanes and bases 425*a*, 426*a* of chambers 425, 426 along the whole of the arc of rotation of ring 12.

It is to be appreciated that, in the illustrated example, one of the vanes (for instance vane 423) is inserted in radial appendage 23, whereas vane 424 is directly inserted in ring 12. In other embodiments, both vanes 423, 424 may be inserted in ring 12 or in the respective appendage 23, 24.

The operation of such a variant embodiment is similar to that described above. Considering vane 423, the difference is that, during rotation, due to the lack of concentricity of wall 425*a* with respect to ring 12 and hence to the increasing radial size of chamber 425, vane 423 will progressively come out from slot 423', whereby its actuating area (and of course its thrust area) and consequently the rotation torque applied to ring 12 progressively increase. This allows compensating, for instance, the increase in the resistant torque caused by the increase in the force exerted by reaction spring 34 and/or by the rotation frictions. What has been stated for vane 423 applies of course also to vane 424.

The invention actually attains the desired aims. By configuring external ring 12 as a multistage rotary piston to which the pressure of the control fluid is directly applied, and by driving stator ring 112 by means of external ring 12, external driving units are eliminated, and hence the structure is simpler and therefore less expensive and less prone to failures, as well as less cumbersome. Both rings, with substantially circular cross section, may be made with limited radial thicknesses. A further limitation in the radial overall size is obtained by configuring the rings so that the movement of the axis of centre O' takes place on a rectilinear trajectory.

It is clear that the above description has been given only by way of non-limiting example and that changes and modifications are possible without departing from the scope of the invention.

For instance, even if in the illustrated embodiment shaft 15*a* of rotor 15 is guided by body 10 whereas spiral spring 34 with the calibration means consisting of casing 33 and ring nut 55 are housed within cover 14, the arrangement could be reversed, or also the spring and the calibration means could be housed within body 10.

Moreover, body 10 might be a through element, which could be possibly formed by means of extrusion or moulding technologies, and might be closed at its ends by suitable covers, centred and aligned by suitable centring means, for instance pegs.

Furthermore, external ring 12 could have, in correspondence of appendages 23 and 24 (or vanes 423, 424), a lightening cavity housing a barrier rigidly connected to the body and communicating with one of chambers 25, 26 (or 425, 426) in order to receive the fluid under pressure fed to such a chamber, so as to offer a greater overall thrust surface. Such a lightening cavity, and possible further similar cavities formed at the periphery of ring 12, could be connected instead to the delivery side of the pump or to the outlet of the oil filter in order to form further regulations stages, preferably controlled from the outside in similar manner to the stage consisting of appendage 24 and chamber 26.

An inversion between the supply and the drains in at least one of the stages could also be possible, so as to add/subtract the actuating torques, thereby allowing the attainment of several variants for the pump calibration and management. Moreover, it is also possible to form radial chambers, steadily connected to the delivery duct under pressure, in order to counterbalance the radial hydraulic thrusts acting on the eccentric rings.

Moreover, even though FIGS. 7 and 8 show chambers 425, 426 with bases 425*a*, 426*a* consisting of arcs of circumferences arranged so that such chambers have progressively increasing radial sizes in the direction of rotation of ring 12 from the maximum displacement position towards the minimum displacement position, it is also possible that the radial sizes of the chambers progressively decrease, if the constructional or operating conditions demand a decrease in the torque exerted by vanes 423, 424 along the arc of rotation of ring 12. In both cases, bases 425*a*, 426*a* might have non uniform curvatures (in any case, curvatures such that the radial size of the respective chamber is in the whole increasing or decreasing), so that a discontinuous variation of the active areas of vanes 423, 424, and hence a discontinuously varying torque along the arc of rotation of ring 12, may be obtained. Of course, at the discontinuity regions, the bases must be shaped so as to allow vane rotation in both directions.

If, in the embodiment with adjustable thrust, lightening cavities with a barrier shaped so as to give rise to further regulation stages are provided, also such stages may have variable thrust areas.

Lastly, even if the invention has been disclosed in detail with reference to a pump for the lubrication oil of a motor vehicle engine, it may be applied to any positive displacement pump for conveying fluid from a first to a second working environment, in which a delivery rate reduction as the pump speed increases is convenient.

The invention claimed is:

1. A variable displacement rotary positive displacement pump for fluids, comprising a rotor arranged to rotate within an eccentric cavity of a stator ring in turn arranged to be rotated within a first predetermined angular interval, as operating conditions of the pump vary, in order to vary a relative eccentricity between the eccentric cavity and the rotor and hence the displacement of the pump, wherein the stator ring is housed within an eccentric cavity of an external ring, which is configured as a multistage rotary piston arranged to be directly driven by a fluid under pressure in order to be rotated within a second predetermined angular interval, and arranged to transmit the rotary motion to the stator ring in order to make it rotate in opposite direction to the external ring.

2. The pump as claimed in claim 1, wherein the eccentric cavities of the stator and external rings have the same eccentricity and, in a minimum displacement condition, are arranged so that their eccentricities are offset by 180°.

3. The pump as claimed in claim 2, wherein a pair of stages of the rotary piston are defined by external radial appendages of the external ring, which are slidable in fluid-tight manner in respective chambers defined between the external ring and a pump body, a first appendage of the external radial appendages being permanently exposed to the action of the fluid under pressure, and a second appendage of the external radial appendages being arranged to be exposed to the action of the fluid under pressure upon an external command, jointly with the first appendage.

4. The pump as claimed in claim 2, wherein facing surfaces of the external ring and the stator ring have formed thereon respective toothed sectors with which an idle toothed wheel meshes, the toothed sector of the external ring being concentric with an external surface of the same ring and the toothed sector of the stator ring being formed on an arc of an involute resulting from a composition of the relative rotations of the eccentricities of the cavities of both rings, so that, during the rotation of the stator ring, a centre (O') of the cavity of the stator ring moves along a rectilinear path.

5. The pump as claimed in claim 2, wherein at least one stage of the rotary piston has an actuating surface, exposed to the action of the fluid under pressure, having an area varying as the position of the piston varies, and is arranged to slide in fluid-tight manner against a base of a chamber defined between the piston and a body of the pump or inside the piston and having a variable radial size that progressively increases or decreases in the direction of rotation of the piston leading to a decrease in the pump displacement.

6. The pump as claimed in claim 1, wherein a pair of stages of the rotary piston are defined by external radial appendages of the external ring, which are slidable in fluid-tight manner in respective chambers defined between the external ring and a pump body, a first appendage of the external radial appendages being permanently exposed to the action of the fluid under pressure, and a second appendage of the external radial appendages being arranged to be exposed to the action of the fluid under pressure upon an external command, jointly with the first appendage.

7. The pump as claimed in claim 6, wherein facing surfaces of the external ring and the stator ring have formed thereon respective toothed sectors with which an idle toothed wheel meshes, the toothed sector of the external ring being concentric with an external surface of the same ring and the toothed sector of the stator ring being formed on an arc of an involute resulting from a composition of the relative rotations of the eccentricities of the cavities of both rings, so that, during the rotation of the stator ring, a centre (O') of the cavity of the stator ring moves along a rectilinear path.

8. The pump as claimed in claim 6, wherein at least one stage of the rotary piston has an actuating surface, exposed to the action of the fluid under pressure, having an area varying as the position of the piston varies, and is arranged to slide in fluid-tight manner against a base of a chamber defined between the piston and a body of the pump or inside the piston and having a variable radial size that progressively increases or decreases in the direction of rotation of the piston leading to a decrease in the pump displacement.

9. The pump as claimed in claim 1, wherein facing surfaces of the external ring and the stator ring have formed thereon respective toothed sectors with which an idle toothed wheel meshes, the toothed sector of the external ring being concentric with an external surface of the same ring and the toothed sector of the stator ring being formed on an arc of an involute resulting from a composition of the relative rotations of the eccentricities of the cavities of both rings, so that, during the rotation of the stator ring, a centre (O') of the cavity of the stator ring moves along a rectilinear path.

10. The pump as claimed in claim 9, wherein the idle toothed wheel is arranged to cooperate with a member opposing the rotation of the external ring, which member comprises a flat spiral spring secured at one end to a shaft of the idle toothed wheel and at the other end to an element rigidly connected to the body, the spring being associated with calibration means arranged to set a desired steady state value for the displacement of the pump.

11. The pump as claimed in claim 10, wherein the flat spiral spring is made of a bimetallic material and has a temperature-depending characteristic.

12. The pump as claimed in claim 1, wherein at least one stage of the rotary piston has an actuating surface, exposed to the action of the fluid under pressure, having an area varying as the position of the piston varies, and is arranged to slide in fluid-tight manner against a base of a chamber defined between the piston and a body of the pump or inside the piston and having a variable radial size that progressively increases or decreases in the direction of rotation of the piston leading to a decrease in the pump displacement.

13. The pump as claimed in claim 12, wherein all stages of said rotary piston have actuating surfaces with variable area.

14. The pump as claimed in claim 1, wherein the pump is a pump for a lubrication circuit of a motor vehicle engine and the fluid under pressure is oil taken from a delivery side of the pump or from a point of the lubrication circuit located downstream an oil filter.

15. A method of regulating the displacement of a rotary positive displacement pump of a kind comprising a rotor arranged to rotate within an eccentric cavity of a stator ring, the method comprising the step of making the stator ring rotate within a first predetermined angular interval in order to vary the eccentricity between the cavity and the rotor, and being characterised in that it further comprises the steps of:

providing an external ring having an eccentric cavity within which the stator ring is housed;

configuring the external ring as a multistage rotary piston;

directly applying fluid under pressure to the piston to make it rotate within a second angular interval; and transmitting the rotation of the piston to the stator ring in such a manner that the two rings rotate in opposite directions.

16. The method as claimed in claim 15, wherein the step of applying fluid under pressure to the piston comprises at least:

applying the fluid to a first stage in order to maintain the displacement, in steady state conditions, at a first preset value;

applying the fluid to a second stage, simultaneously with the application to the first stage and upon an external command, in order to bring the displacement to a second value different from the first one.

17. The method as claimed in claim 16, wherein the step of applying fluid under pressure to the piston comprises applying the fluid, in at least one stage of said rotary piston, to an actuating surface of which the area is made to vary as the position of the rotary piston varies, and wherein said variation of the area of the actuating surface is performed through the steps of:

configuring the stages of the rotary piston as piston appendages radially slidable relative to the piston itself and having one end arranged to slide in fluid-tight manner, during the rotation of the piston, against a base of a respective chamber defined either between the piston itself and a body of the pump or inside the piston; and making at least the end of the appendage forming said at least one stage slide in a chamber with variable radial size.

18. The method as claimed in claim 15, wherein the step of applying fluid under pressure to the piston comprises applying the fluid, in at least one stage of said rotary piston, to an actuating surface of which the area is made to vary as the position of the rotary piston varies, and wherein said variation of the area of the actuating surface is performed through the steps of:

configuring the stages of the rotary piston as piston appendages radially slidable relative to the piston itself and having one end arranged to slide in fluid-tight manner, during the rotation of the piston, against a base of a respective chamber defined either between the piston itself and a body of the pump or inside the piston; and making at least the end of the appendage forming said at least one stage slide in a chamber with variable radial size.

19. The method as claimed in claim 15, further comprising the step of opposing the transmission of the rotation of the external ring to the stator ring with a force depending on the temperature of the pumped fluid.

20. The method as claimed in claim 15, for regulating the displacement of a pump for the lubrication oil for an engine of a motor vehicle.

* * * * *